US006149034A

United States Patent [19]

Amberg et al.

[11] Patent Number: 6,149,034

[45] Date of Patent: Nov. 21, 2000

[54] PASTE DISPENSER

[75] Inventors: Guenther Amberg, Neuss; Wolfgang Huber, Friedolfing, both of Germany

[73] Assignee: Henkel Kommaditgesellschaft auf Aktien, Duesseldorf, Germany

[21] Appl. No.: 09/284,376

[22] PCT Filed: Oct. 1, 1997

[86] PCT No.: PCT/EP97/05402

§ 371 Date: May 10, 1999

§ 102(e) Date: May 10, 1999

[87] PCT Pub. No.: WO98/15684

PCT Pub. Date: Apr. 16, 1998

[30] Foreign Application Priority Data

Oct. 10, 1996 [DE] Germany ..... 196 41 746

[51] Int. Cl.[7] ..... B67D 5/00

[52] U.S. Cl. ..... 222/82; 222/83; 222/95; 222/152; 222/185.1; 222/386

[58] Field of Search ..... 222/81, 82, 83, 222/83.5, 95, 152, 185.1, 386, 386.5

[56] References Cited

U.S. PATENT DOCUMENTS

| | | | |
|---|---|---|---|
| 4,421,253 | 12/1983 | Croley | 222/83 |
| 4,889,644 | 12/1989 | Amberg et al. | 252/8.9 |
| 5,072,857 | 12/1991 | Coleman | 222/386.5 |
| 5,435,462 | 7/1995 | Fujii | 222/82 |
| 5,505,336 | 4/1996 | Montgomery et al. | 222/83 |
| 5,732,853 | 3/1998 | Ganzeboom et al. | 222/82 |
| 5,878,915 | 3/1999 | Gordon et al. | 222/83 |

FOREIGN PATENT DOCUMENTS

| | | |
|---|---|---|
| 0 295 525 | 12/1988 | European Pat. Off. . |
| 0 459 943 | 12/1991 | European Pat. Off. . |
| 28 04 810 | 8/1979 | Germany . |
| 44 30 418 | 10/1995 | Germany . |
| 44 14 708 | 11/1995 | Germany . |

*Primary Examiner*—Joseph A. Kaufman
*Attorney, Agent, or Firm*—Wayne C. Jaeschke; Glenn E. J. Murphy; Kenneth Watov

[57] ABSTRACT

The invention relates to a device enabling delivery of a paste from a flexible storage container located in a dimensionally stable container. Product is fed into a dosing device which dispenses product under vacuum. A follow-up plate is located on the top portion of the flexible storage container exerting pressure upon it. An opening is provided at the bottom of the container. On the edge of the opening a sealing device is arranged. Inside this arrangement a tight connection is made between the flexible storage container and access to the dosing device. Access to the dosing device can be barred. The sealing device is a sealing ring. Inside the opening of the sealing ring an upwardly turned blade is located in a conduit that connects to the dosing device. Between the blade and the connecting conduit a free cross section is available in order to enable paste flow.

13 Claims, 2 Drawing Sheets

PASTE DISPENSER

BACKGROUND

1. Field Of The Invention

This invention relates generally to dispensers for viscous material, and more particularly to a system or apparatus for delivering and guiding a paste from a flexible storage container accommodated in a dimensionally stable container ("pot") downwards into a dispenser operating by reduced pressure.

2. Discussion Of Related Art

Liquid to paste-form detergents are known in large numbers. They are generally formulated to meet domestic requirements, i.e. they are expected to be sufficiently liquid so that they can be poured out and measured/dosed without difficulty. Since, in addition, they are expected to be stable in storage over a relatively broad temperature range, the use of organic solvents and/or hydrotropic additives cannot normally be avoided. However, such additives do not contribute to the actual washing process, are comparatively expensive and, in addition, take up packaging space and transportation and storage capacity. The presence of inflammable solvents is particularly troublesome and necessitates additional safety precautions on account of the relatively high consumption of detergents in laundries. Because of this, detergent concentrates of the type mentioned can only be used to a limited extent, if at all, in laundries.

Accordingly, powder-form detergents are mainly used in laundries. Since the exact dosing of powder-form detergents is problematical or labor-sensitive, particularly in large and extensively automated laundries, the detergents are mostly stored and dispensed in predissolved form as stock liquors, i.e. a water-based concentrate is prepared and delivered to the individual points of consumption. However, the detergents typically used in laundries contain comparatively high levels of washing alkalis which are only soluble to a limited extent in cold water and, lead to so-called salting-out effects. They promote phase separation with the result that the organic components, more especially the nonionic surfactants and soaps, separate and cream up. Accordingly, the concentrates have to be diluted relatively heavily with water, and in addition, the stock liquors have to be constantly and intensely mixed and circulated to prevent individual components being deposited in the feed lines to the points of consumption. Processes such as these require considerable investment in large mixing vessels and the associated static mixers and feeders, and also require a constant supply of energy for the heating and circulation of the stock liquors.

A detergent which meets these requirements is proposed in EP 0 295 525. This detergent is a paste which imposes particular demands on handling for the purpose of dosing and mixing with water as solvent. Detergent pastes such as these are transported and stored in large containers.

SUMMARY OF THE INVENTION

The technical problem addressed by the present invention is to design a system or apparatus in such a way that the paste is safely and controllably delivered by simple means, and the system guarantees an air-tight connection to the dispenser operating by reduced pressure and trouble-free, complete emptying. The solution to this problem in one embodiment of the invention includes a sealing arrangement at the edge of an opening, inside which an air-tight connection can be established between a flexible storage container held in a pot, and the access opening to an underlying dispenser, the access to the dispenser being designed to be shut off.

The proposed apparatus has the advantage that the flexible storage container can be completely emptied because it is guaranteed that the constituent material of the flexible container does not block or impede the feed paths of the paste. This could easily happen if the connection between the flexible storage container and the access to the dispenser is not airtight or if, through the emptying of the non-stretched storage container, parts of the container material slip forward and prematurely cover the container outlet before all the paste had been removed.

According to the invention, two alternative solutions to the problems in the prior art are proposed. In a first embodiment, the apparatus comprises a sealing ring within the opening of which an upwardly directed knife is arranged in a connecting passage to the dispenser. A free cross-section for the passage of the paste is present between the knife and the connecting opening or passageway. In this way, it is readily possible with advantage for the flexible storage container to be automatically cut open on introduction into a pot, a pressure-tight seal to the outside being simultaneously guaranteed by the sealing lips. Accordingly, the paste is only delivered from this arrangement when the access from the flexible container to the dispenser is open. At the same time, a reduced pressure by which the dispenser delivers the paste can also be activated. The pressure-tight seal to the outside becomes particularly effective if a sealing lip directed upwards, preferably obliquely upwards, is provided on the sealing ring, and when the container is introduced in to the pot, applies itself firmly to the flexible material of the container. A follower plate is positioned over the flexible container.

If the knife is arranged in such a way that it projects into the lower part of the pot, a corresponding recess is advantageously provided in the follower plate so that the material of the flexible container guided under the follower plate does not touch the knife, even when the outer edge is resting on the bottom of the pot. This also usefully ensures that, when the container is almost empty, the paste present at the margins of the container is first displaced towards the center by the descending follower plate and the paste residues then concentrate in the space which is formed in the opening or between the bottom of the pot and the recess in the follower plate.

In one particular embodiment, the knife is cruciform in shape which very simply and effectively facilitates the provision of free cross-sections for the passage of the paste. In addition, the cruciform incision into the material of the container results in the formation of comers which, as the paste flows through, fold in the direction of flow within the sealing arrangement and do not impede flow.

Another embodiment of the invention includes a commercially available container neck in the flexible container, which on introduction into the pot fits onto the container opening, the clamping ring of the container neck fitting onto the rim of the opening. The neck thus projects through the opening toward the dispenser. If an insert designed to be sealed off both from the surrounding atmosphere and through a passage arranged in the direction flow from the dispenser is tightly inserted into the container neck, the air-tight connection of the container to the dispenser can be established very effectively with simple means.

The paste is normally so viscous that a closure cap closing the passage can be removed before the container is introduced into the pot and, hence, before the passage is inserted into the access to the dispenser. A relatively low paste viscosity, which could cause the paste to escape unintentionally before the air-tight connection to the access to the dispenser had been established, can advantageously be taken into account by equipping the passage with a closure designed to open automatically on insertion into the access of the dispenser. A sleeve provided in its wall with at least one cut-out extending from the passage/sleeve junction to just beneath the upper edge of the sleeve and arranged above the insertion passage, i.e. directed from the passage towards the interior of the container, advantageously stabilizes the outflow of paste and guarantees complete emptying of the container. Here, too, particular advantages are afforded by the combination of such an arrangement with a corresponding recess in the follower plate in the central region of the arrangement of the container neck and the sleeve.

BRIEF DESCRIPTION OF THE DRAWINGS

The above-mentioned advantages and other advantages are illustrated by the accompanying description of embodiments which are shown in the accompanying drawings, in which like items are identified by the same reference designation, wherein.

DETAILED DESCRIPTION OF THE INVENTION

Figure 1:
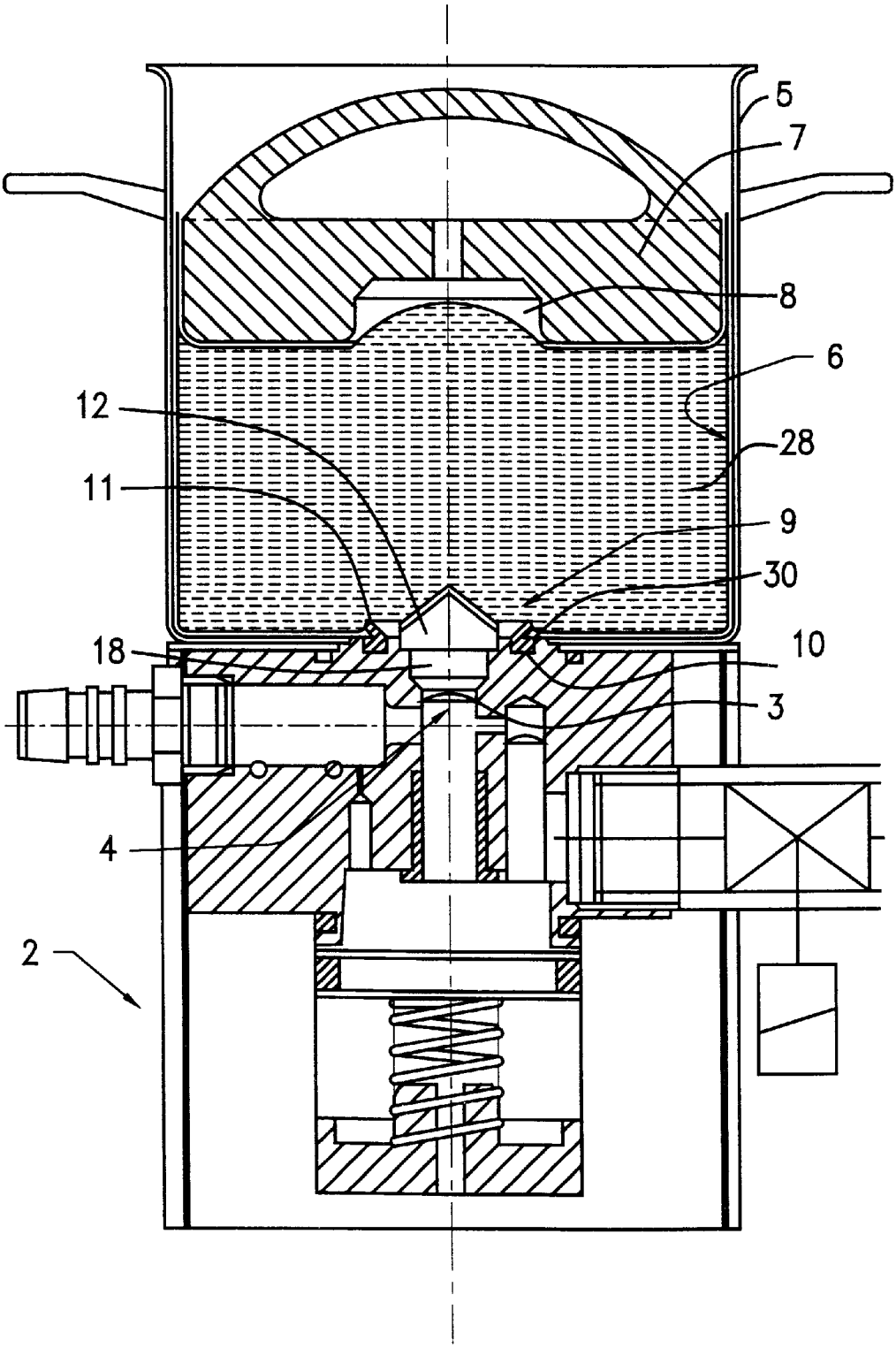
FIG. 1 shows an arrangement with a sealing lip and cruciform knife.

In the illustrations of the two embodiments, the dispenser 2 is schematically shown in the lower part, its access 3 being designed to be shut off by a closure 4. Mounted on the frame of the dispenser 2 is a dimensionally stable pot 5 with an opening 9 in its base. Introduced into the pot 5 is a flexible container 6 which, preferably, also serves as a transport container for the washing paste 28. Placed on the flexible container 6 is a follower plate 7 which weighs a few kilos and which fits into the pot in such a way that only a narrow gap is present between the follower plate 7 and the inner wall of the pot 5. An excess length of the material from which the flexible container 6 is made may optionally be arranged in this gap if the flexible container is so designed.

As can clearly be seen from FIG. 1, a sealing ring 10 is arranged in the opening 9 of the pot. The sealing ring 10 has an encircling sealing lip 11 directed obliquely upwards. Since the sealing ring 10 is within the housing of the dispenser 2 and since the bottom of the pot 5 is inserted into the annular groove 30 between the sealing ring 10 and the sealing lip 11, this arrangement effectively seals off the system from the outside. The cruciform knife 12 projecting into the pot 5 or container slits open the constituent material 20 of the flexible container 6 when the container 6 is introduced into the pot 5 and pressed downwards. Between the blades of the knife 12 which are arranged crosswise, the cut-open corners of the container yield to the pressure of the paste 28 and bend downwards so that they do not offer any resistance to the paste 28. In the segments between the blades of the knife 12, there is enough free cross-section for the passage of paste 28 which is able to enter the connecting passage 18 where there is a transition to the access 3 of the dispenser 2 which, in the illustrated embodiment, is sealed by a closure 4.

If the access 3 is opened, the reduced pressure produced by the injector on the principle of a water jet pump can be activated to take in the paste 28. After the predetermined dose has been dispensed, the access 3 is closed again to stop the delivery of paste 28.

Figure 2:
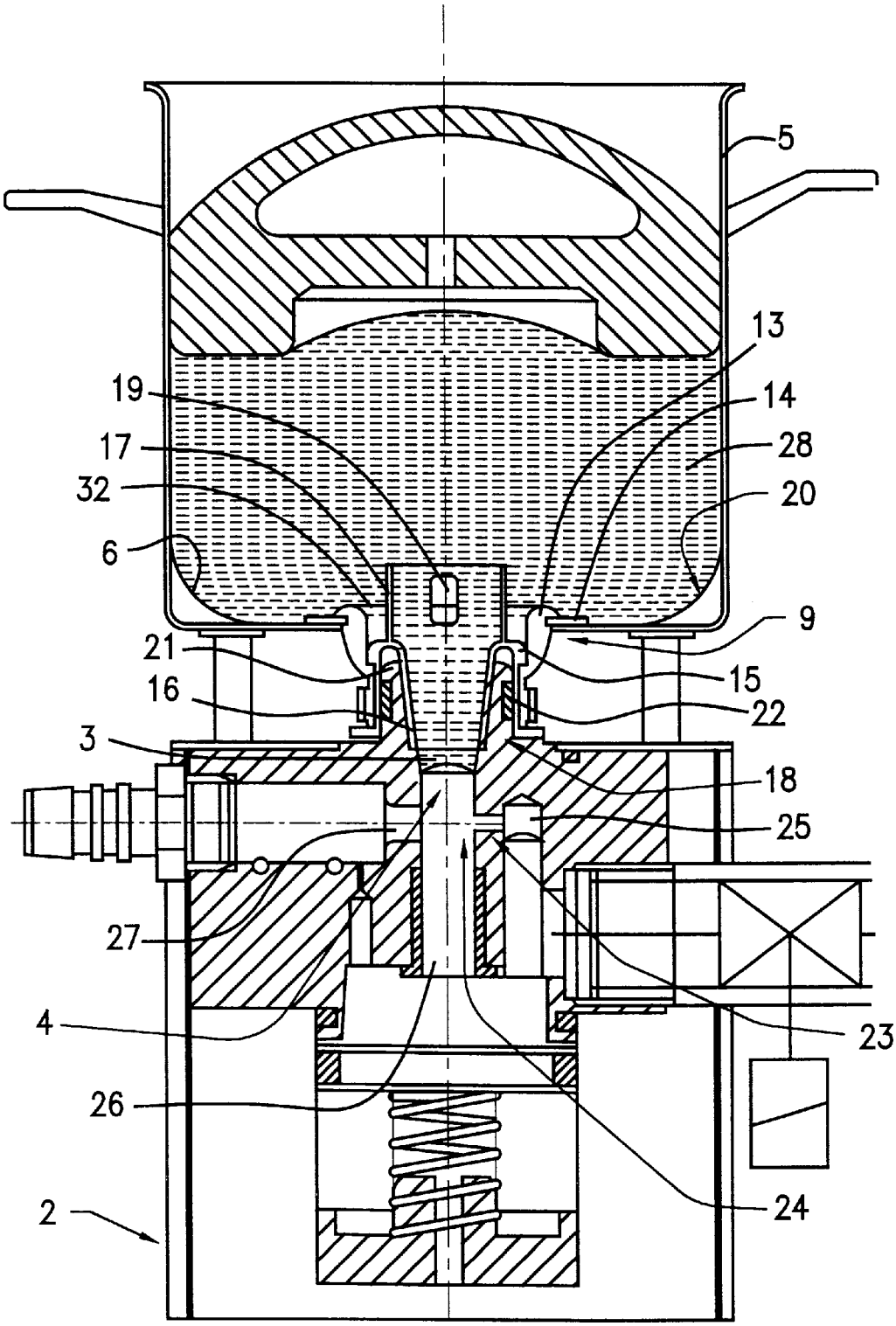
FIG. 2 shows an arrangement with a container neck and an insert arranged therein.

FIG. 2 shows an embodiment in which a commercially available container neck 13 is inserted into the flexible container 6 in such a way that, when the flexible container 6 is introduced in to the pot 5, the container neck 13 fits into the opening 9 of the pot 5, the flat underside of the clamping ring 14 applying itself to the rim of the opening 9. The flexible material 20 of the container 6 is tightly clamped by the clamping ring 14 in a gap between the clamping ring 14 and the container neck 13. Inserted into the central opening of the container neck 13 is an insert 15 which is held against the sleeve-like part of the neck 13 by an annular fillet directed radially outwards and an annular bead projecting radially outwards. The cylindrical outer wall of the insert 15 is bent radially inwards at its end nearer the pot 5 and merges into a passageway 16 which is turned slightly conically away from the pot 5. At its lower end, the passageway 16 is closed by a cap (not shown). If the cap is integrally connected to the passage 16, it is separated before the container 6 is introduced into the pot 5, although this does not result in any leakage of the paste 28 by virtue of its relatively high viscosity. For pastes 28 of low viscosity, a special embodiment may also be designed in such a way that the cap opens automatically when the passageway 16 is inserted into the access 3 to the dispenser 2.

The slightly conical shape of the passage 16 enables it to be tightly connected to the access 3. Arranged at the end of the insert 15 nearer the pot 5 is a sleeve 17 which projects into the pot 5. The sleeve 17 comprises a cut-out 19 extending from the point where the bead 32 merges into the sleeve 17 to just below the upper edge of the sleeve 17. Provided in an upwardly extending annular fillet 21 of the dispenser 2, inside which the connecting passage 18 is formed, are externally annular sealing elements 22 which establish a seal between the dispenser 2 and the insert 15 mounted on fillet 21.

The embodiment in which a sealing arrangement is present at the edge of the opening 9 to enable a tight connection to be established between the flexible storage container 6 and the access 3 of the dispenser 2, is particularly suitable, even in the form of the two alternative embodiments, for combination with a dispenser 2 comprising an injector 23. A fluid under high pressure, for example water under pressure, is delivered into the injector nozzle 23 via a passageway 25 designed to be shut off, the water which expands after passing through the injector nozzle 23 flowing into an opposite access 27 to a measuring sector. The injector nozzle 23, which operates on the principle of a water jet pump, generates a reduced pressure on the suction side 24 which can be transmitted through the delivery passageway 26 to the access 3 of the dispenser 2. The pressure-tight connection between the flexible container 6 and the access 3 advantageously enables the reduced pressure to take in the paste 28 from the flexible container 6 and to deliver it to the dispenser 2. During this phase, the two passageways 25 and 26 are closed by a dual control piston system.

The special feature of this control system lies inter alia in the fact that the pistons are adapted to one another in such a way that the closure 4 of the passageway 26 is always opened before the piston closing the channel 25 has descended to such an extent that the water under high pressure is able to flow in and generate the reduced pressure required to deliver the paste 28 via the injector. Since the water is the solvent for the paste 28, simple and effective mixing is guaranteed in this way. The dispensing process is controlled by a conductivity measurement in the measuring sector behind the access 27 which enables the exact concentration of the dissolved paste 28 and hence the quantity to be determined. When the preset dose size has been reached, the passages 25 and 26 are closed again in reverse order.

Although various embodiments of the invention have been shown and described, they are not to be limiting. Those of skill in the art may recognize certain modification to these embodiments, which modification are meant to be covered by the spirit and scope of the appended claims.

What is claimed is:

1. Apparatus for delivering and guiding a paste from a flexible storage container accommodated in a dimensionally stable pot downwards into a dispenser operating by reduced pressure, the flexible storage container being surmounted by a follower plate which applies pressure to the storage container, and an opening being present in the base of the pot, wherein a sealing arrangement is present at the edge of the opening, inside which an air-tight connection is established between the flexible storage container and the access to the dispenser, the access to the dispenser being designed to be shut off.

2. Apparatus as claimed in claim 1, wherein the sealing arrangement is a sealing ring surrounding an upwardly directed knife arranged within the opening of the sealing ring in a connecting passageway to the dispenser, an open cross-section for the passage of paste being present between the knife and the connecting passage.

3. Apparatus as claimed in claim 2, wherein the sealing ring comprises an upwardly directed sealing lip which applies itself firmly to the flexible container material.

4. Apparatus as claimed in claim 3, wherein the knife is arranged in such a way that it projects into the pot, and the follower plate comprises a recess that, when it rests on the bottom of the pot, it does not touch the knife or the sealing lip.

5. Apparatus as claimed in claim 3, wherein the knife is cruciform in shape.

6. Apparatus as claimed in claim 1 wherein the knife is arranged in such a way that it projects into the pot, and the follower plate comprises a recess that, when it rests on the bottom of the pot, it does not touch the knife or the sealing lip.

7. Apparatus as claimed in claim 6, wherein the knife is cruciform in shape.

8. Apparatus as claimed in claim 6, wherein the knife is cruciform in shape.

9. Apparatus as claimed in claim 8, wherein the sealing arrangement consists of a container neck in which an insert is tightly arranged, the insert being designed to be sealed off from the dispenser and comprising a passageway designed to be connected to the access to the dispenser.

10. Apparatus as claimed in claim 3, further including a closure designed to open automatically when the passageway is inserted into the access to the dispenser that is present at the front end—relative to the flow direction—of the associated passageway.

11. Apparatus as claimed in claim 3, further including a sleeve projecting into the container and arranged above and connected to the passageway, the sleeve being provided in its wall with at least one cut-out extending from the junction between the passageway and the sleeve to just below an upper edge of the sleeve.

12. Apparatus as claimed in claim 4, further including a sleeve projecting into the container and arranged above and connected to the passageway, the sleeve being provided in its wall with at least one cut-out extending from the junction between the passageway and the sleeve to just below an upper edge of the sleeve.

13. Apparatus as claimed in claim 12, wherein the follower plate comprises a recess so that, when it rests on the bottom of the pot, it does not touch the container neck or the sleeve.

* * * * *